US005518174A

United States Patent [19]

Botterman

[11] Patent Number: 5,518,174

[45] Date of Patent: May 21, 1996

[54] LINED CARTON WITH SIFT-RESISTANT DISPENSING FEATURE

[75] Inventor: David L. Botterman, Arlington, Tex.

[73] Assignee: Jefferson Smurfit Corporation, Clayton, Mo.

[21] Appl. No.: 522,694

[22] Filed: Sep. 1, 1995

[51] Int. Cl.[6] ..... B65D 5/56; B65D 5/70

[52] U.S. Cl. ..... 229/207; 220/416; 229/215; 229/221

[58] Field of Search ..... 229/207, 214, 229/215, 217, 221, 223, 242, 243; 220/416, 418

[56] References Cited

U.S. PATENT DOCUMENTS

| | | | |
|---|---|---|---|
| 1,931,991 | 10/1933 | Mergentheim | 229/207 |
| 2,819,831 | 1/1958 | Polarek et al. | 229/221 |
| 2,820,585 | 1/1958 | Nerenberg et al. | 229/221 |
| 3,853,261 | 12/1974 | Moore | 229/207 |
| 4,953,707 | 9/1990 | Wein | 229/207 |
| 5,044,503 | 9/1991 | Wein | 229/215 |
| 5,219,089 | 6/1993 | Kiolbasa et al. | 220/416 |
| 5,344,066 | 9/1994 | Fogle | 220/416 |

FOREIGN PATENT DOCUMENTS

| | | | |
|---|---|---|---|
| 2124285 | 12/1971 | Germany | 229/215 |
| 510965 | 8/1939 | United Kingdom | 229/243 |
| 925975 | 5/1963 | United Kingdom | 229/221 |
| 2045723 | 11/1980 | United Kingdom | 229/221 |
| 9002689 | 3/1990 | WIPO | 229/221 |

*Primary Examiner*—Gary E. Elkins
*Attorney, Agent, or Firm*—Richard W. Carpenter

[57] ABSTRACT

A lined dispensing carton with a sift-resiatant dispensing opening in a side wall of the carton that is covered by a hinged reclosable flap that can be folded and inserted into the carton for cooperation with a portion of a carton liner to render that carton relatively sift-resistant upon reclosure.

20 Claims, 2 Drawing Sheets

LINED CARTON WITH SIFT-RESISTANT DISPENSING FEATURE

BACKGROUND OF THE INVENTION

1. Field of the Invention

This invention relates to dispensing cartons of the type used for the packaging of granular products such as detergent, and more particularly to a carton with an improved dispensing opening and reclosure arrangement that is sift-resistant.

2. Description of the Background Art

A background art search directed to the subject matter of this invention conducted in the United States Patent and Trademark Office disclosed the following United States Letters Patent:

| | | | |
|---|---|---|---|
| 2,233,602 | 4,809,853 | 4,909,395 | 4,953,707 |
| 4,953,781 | 5,044,503 | 5,219,089 | 5,236,123 |
| 5,328,091 | | | |

None of the patents uncovered in the search discloses a lined dispensing carton with a dispensing opening covered by a hinged reclosable flap that can be folded to cooperate with a portion of a carton liner to render the carton relatively sift-resistant upon reclosure.

SUMMARY OF THE INVENTION

It is a primary object of the invention to provide a lined dispensing carton with a sift-resistant opening and reclosure.

Another object of the invention is the provision of a lined carton of the type described having a dispensing opening in a side wall that is closed and covered by a pair of hinged closure flaps defined by double cut scores.

A more specific object of the invention is to provide a carton of the type described wherein one of the hinged reclosure flaps can be folded and reinserted into the carton in cooperation with the carton liner to provide a positive, user friendly reclosure.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
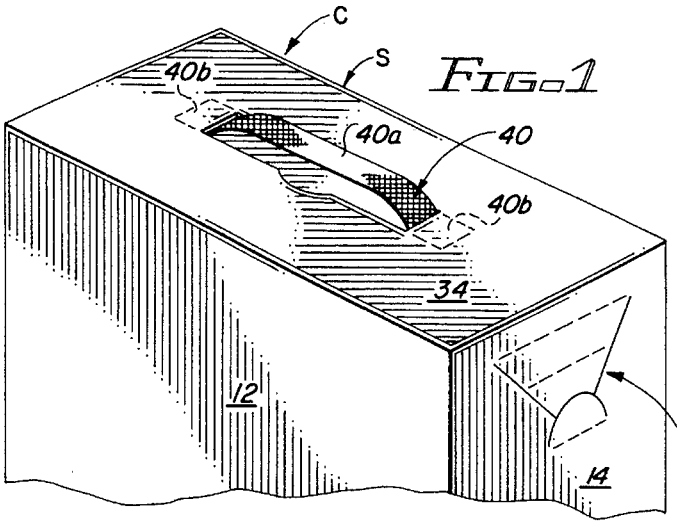
FIG. 1 is an isometric view of the upper portion of a carton having a dispensing feature embodying features of the present invention.
Figure 6:
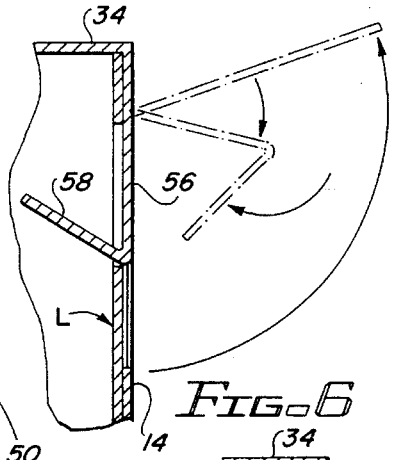
FIGS. 5 and 6 are vertical sectional views taken on lines 5—5 and 6—6 of FIGS. 3 and 4, respectively.
Figure 3:
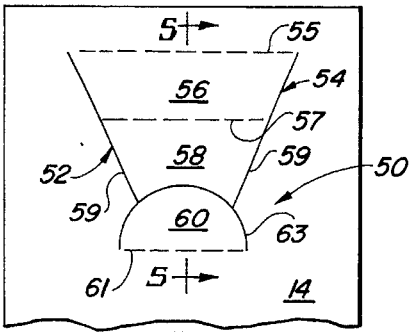
FIGS. 3 and 4 are side elevational views of a portion of the structure illustrated in FIG. 1, with the dispensing structure shown before opening and after reclosure, respectively.
Figure 2:
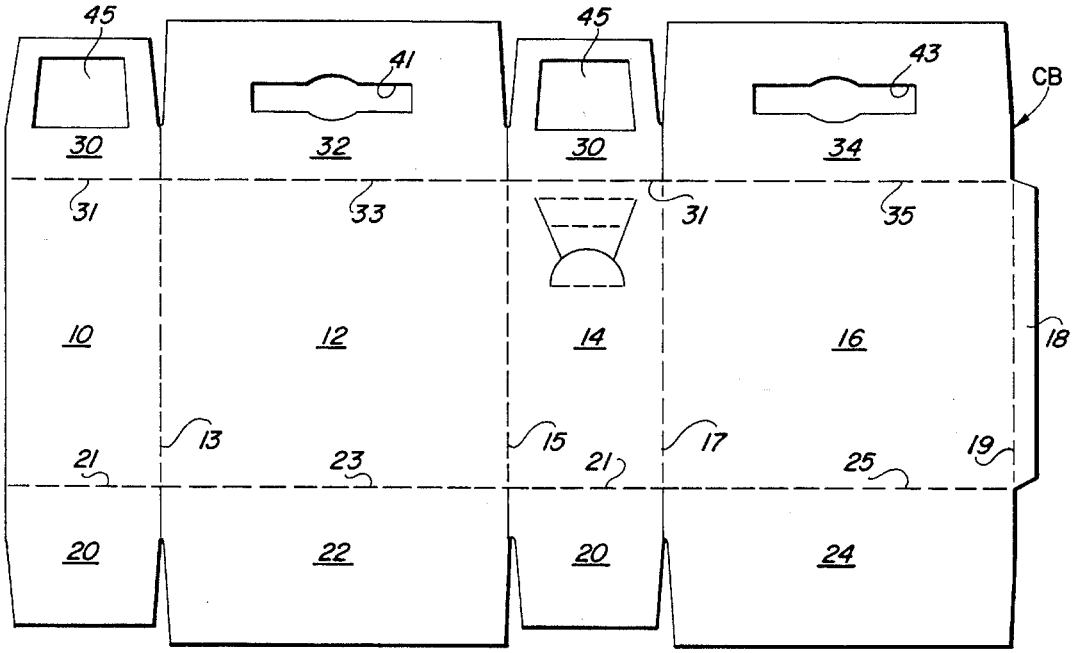
FIG. 2 is a plan view of a blank of sheet material from which the carton illustrated in the other views may be formed.
Figure 7:
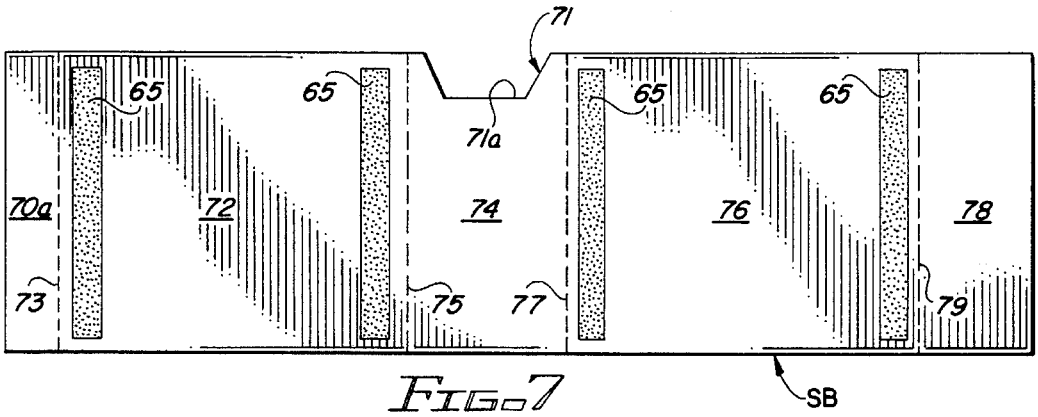
FIG. 7 is a plan view of a blank of sheet material from which the carton outer shell illustrated in the other views may be formed.

Referring now to the drawings for a better understanding of the invention, it will be seen that the outer shell S of the composite carton, indicated generally at C in FIG. 1, may be formed from the unitary blank SB of foldable sheet material, such as paperboard illustrated in FIG. 2; and the liner L of the carton C can be formed from the unitary blank LB of sheet material illustrated in FIG. 7.

Figure 9:
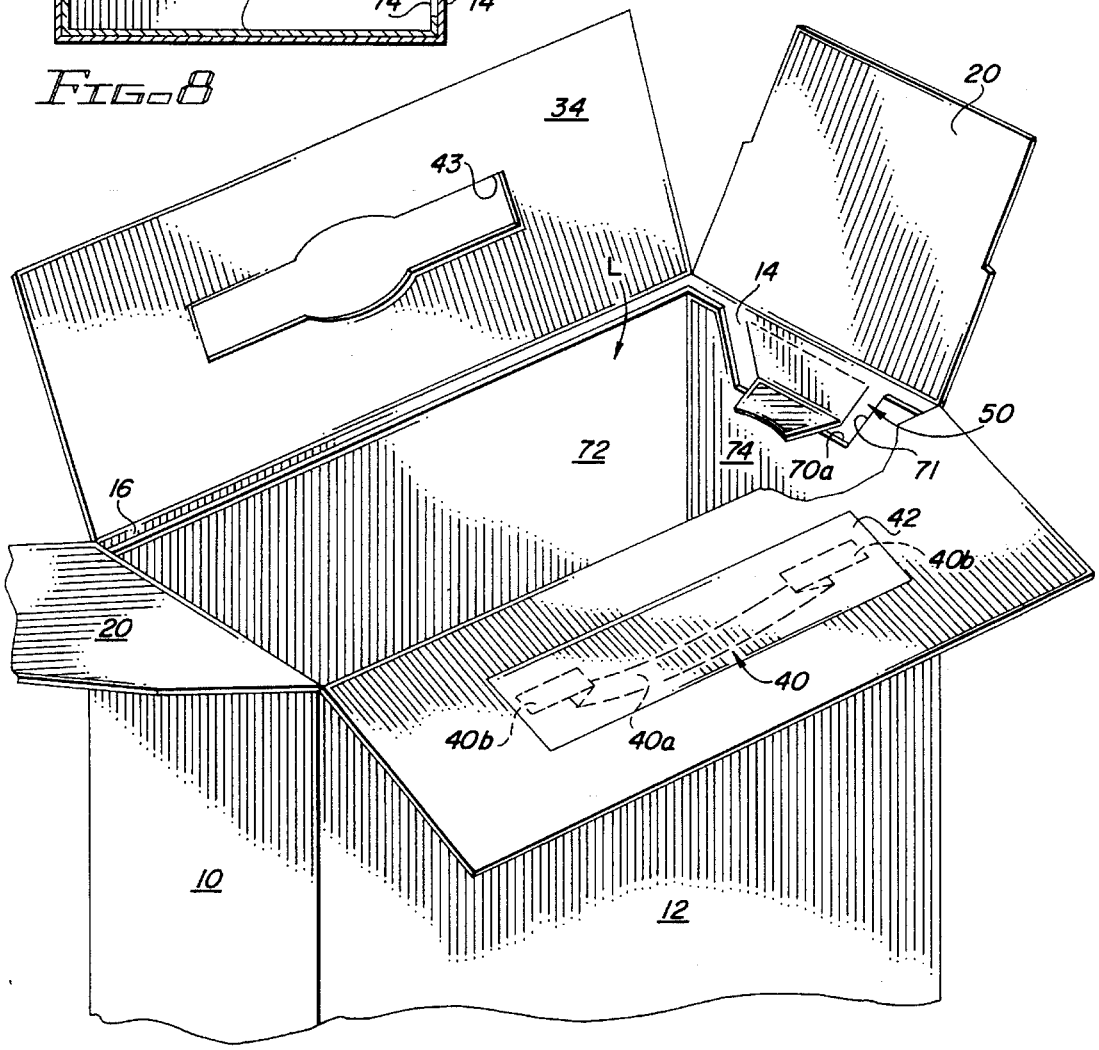
FIG. 9 is an isometric view of the carton structure illustrated in FIG. 4, with the upper flaps opened to show the manner in which the carton can be reclosed.

As best seen in FIGS. 2 and 9, carton outer shell S includes a first minor side wall panel 10, a first major side wall panel 12, a second minor side wail panel 14, a second major side wall panel 16, and a glue flap 18, which are foldably joined to each other along parallel fold lines 13, 15, 17, and 19, The lower end of the carton shell may be closed by a pair of lower inner closure flaps 20, foldably joined along fold lines 21 to lower ends of minor side wall panels 10 and 14; a lower intermediate closure flap 22, foldably joined along a fold line 23 to the lower end of first major side wail panel 12; and a lower outer closure flap 24, foldably joined along a fold line 25 to the lower end of second major side wail panel 16.

The lower closure flaps may be folded over and adhesively secured to each other in overlapped relation.

In a similar manner the upper end of the carton shell may be closed by a pair of upper inner closure flaps 30, foldably joined along fold lines 31 to upper ends of minor side wall panels 10 and 14; an upper intermediate closure flap 32, foldably joined along a fold line 33 to the upper end of first major side wall panel 12; and an upper outer closure flap 34, foldably joined along a fold line 35 to the upper end of second major side wall panel 16.

The upper closure flaps may also be folded over and secured to each other in overlapped relation.

For larger cartons embodying features of the present invention, a handle arrangement, such as that indicated generally at 40, may be provided. It should be understood that the essential feature of the present invention is the sift-resistant, reclosable, dispensing opening feature described later herein, and that other types of handle arrangements may be used for the carton.

As best seen in FIGS. 1, 2, and 9, the handle arrangement 40 includes a relatively narrow, thin, plastic strip 42 having a center portion 42*a*, adapted to project upwardly out of the carton through openings 41 and 43 in the upper intermediate and outer closures flaps 32 and 34, respectively, and a pair of end portions 42*b*, secured to the underside of intermediate closure flap 32 around the periphery of opening 41 by a relatively thin paperboard or plastic retaining strip 44.

In order to accommodate the presence of the handle end portions and still maintain the upper closure flaps even and sift-proof, upper inner closure flaps may be debossed slightly to provide slight depressions, as indicated at 45.

As seen in FIGS. 1–4, the second minor side wall panel 14 is provided with a reclosable dispensing arrangement indicated at 50, which includes a somewhat key-hole or hour-glass shaped dispensing opening indicated generally at 51, that comprises adjacent communicating upper and lower portions 51*a* and 51*b*, respectively.

Dispensing opening 51 may be closed by a two-piece dispensing closure flap member, indicated generally at 52, which comprises a pair of cooperating, separate, contiguous, upper and lower elements 54 and 60, respectively, which, when moved out of the plane of the side wall panel, form the opening 51.

Upper element 54 is preferably in the shape of an inverted triangle, with the lower end cut off. Upper element 54 includes an upper section 56, foldably joined at its upper edge along a fold line 55 to second minor side well 14 adjacent the upper end thereof, and a lower section 58, foldably joined at its upper edge along fold line 57 to a lower edge of upper section 56.

Upper element 54 is defined partly by the fold line 55 and a pair of vertical lines of weakness 59 that extend downwardly from the ends of fold line 55.

Lower element 60 is preferably in the form of a semicircle and is foldably joined at its lower edge along a fold line 61 to second minor side wall panel 14. Lower element 60 is partly defined by the fold line 61 and a pair of lines of weakness 63 that extend upwardly from the ends of fold line 61.

Figure 4:
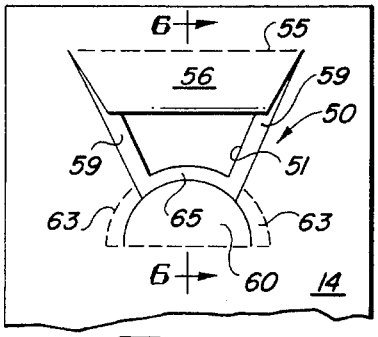
Figure 5:
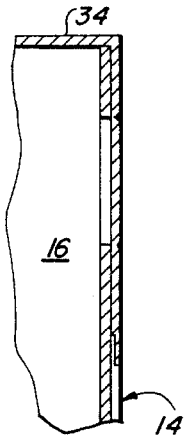

As best seen in FIG. 4, the adjacent ends of lines 59 and 63 are interconnected by a common line of weakness 65. All of the lines of weakness are formed by parallel cuts from opposite sides of the paperboard.

Figure 8:
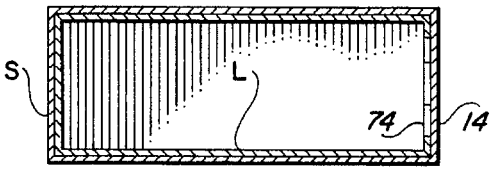
FIG. 8 is a reduced horizontal cross sectional view of the carton structure illustrated in FIG. 1, taken at a location just below the upper closure flaps of the carton.

Turning now to FIGS. 7–9, it will be seen that a separate liner L for the shell S is illustrated. Liner L may be formed from the unitary paperboard blank LB illustrated in FIG. 7.

Liner L includes a first minor panel first section 70*a*, a first major panel 72, a second minor panel 74, a second major panel 76, and a first minor panel second section 70*b* which are foldably joined to each other along parallel fold lines 73, 75, 77, and 79.

When the carton C is formed liner blank LB is placed against the inside surface of shell blank SB, as shown in FIG. 9, and adhesively secured to an upper portion thereof. Preferably the major panels of the liner are secured to the major side wall panels of the shell, and related minor panels of the liner and minor side wall panels of the shell are free from attachment to each other.

Liner second minor panel is provided, at its upper edge, with a recess 71 which presents an upper edge 71*a*. It is important to note that the liner must be secured to the shell in such a way that the upper edge 71*a* of liner recess 71 is vertically aligned perfectly with the fold line 57 which joins the upper and lower sections 56 and 58 of the upper element 54 to each other.

After the carton shell S and liner L have been attached to each other, the carton can then be formed, filled, and closed.

To open the carton, first the closure flap member lower element 60 is pushed inwardly a sufficient amount to separate element 60 from shell second minor side wall panel 14 and from upper element upper section 56.

Then both sections of upper element 54 are lifted or pulled away from the carton shell side wall panel 14 to expose the upper portion 51*a* of the dispensing opening 51.

It will be seen that the lower portion 51*b* of the opening 51 is covered by the adjacent minor panel 74 of the liner L, so that, as a practical matter, product will be dispensed from the carton through the upper portion 51*a* of opening 51.

In order to reclose the carton, after product has been dispensed therefrom, the lower section 58 of upper element 54 is folded 90 degrees and tucked into the carton at a location immediately adjacent the upper edge 71*a* of the recess 71 in the related liner minor panel 74. In this way the opening upper portion 51*a* is covered by the upper section 56 of the upper element 54, while the remaining portion of the opening 51 is covered by the adjacent minor panel of the liner L.

Thus, the invention provides a relatively simple and economical package with a reclosable dispensing opening that is relatively sift-resistant.

What is claimed is:

1. A two-piece carton with a sift-resistant, reclosable, dispensing feature, said carton comprising:

(a) an outer shell including top, bottom, side, and end walls foldably joined to each other to form a box-like structure;

(b) an inner liner including side wall and end wall panels positioned against inner surfaces of said outer shell side and end walls, respectively;

(c) one of said shell end walls consisting of a single wall panel having a dispensing opening covered by a pair of contiguous upper and lower flaps foldably joined to said one end wall panel along vertically spaced, parallel, horizontal, first and second fold lines, respectively;

(d) said lower flap being foldably joined to said one end wall along said second fold line, and being detachably joined to said one end wall by a pair of laterally spaced, generally vertically extending, separate, lower lines of weakness extending upwardly from opposite ends of said second fold line;

(e) said upper flap including:

(i) an upper section foldably joined at its upper edge to said one end wall panel, along said first fold line; and (ii) a lower section joined at its upper edge to a lower edge of said upper section, along a third fold line that is aligned vertically with a horizontal upper edge of said liner;

(f) both of said upper flap sections being detachably joined to said one end wail by a pair of separate, laterally spaced, generally vertically extending, upper lines of weakness extending downwardly from opposite ends of said first fold line, and said lower section being detachably joined to said lower flap by a common, central line of weakness that extends between adjacent ends of said upper and lower lines of weakness;

(g) said lower flap being arranged and disposed to be pushed inwardly to partially detach it from said one end wall and said upper flap and to accommodate the insertion of a finger under said upper flap;

(h) said upper flap being arranged and disposed to be lifted to partially detach it from said one end wall and to uncover said dispensing opening in said one end wail, and also being arranged and disposed to accommodate the bending of said lower section at right angles to said upper section to permit its insertion into said shell at a location immediately adjacent said inner liner horizontal upper edge to effect a sift-resistant reclosure of a portion of said dispensing opening that is not already covered by said liner.

2. A carton according to claim 1, wherein said upper lines of weakness converge downwardly.

3. A carton according to claim 1, wherein said lower lines of weakness are connected to each other by said central line of weakness and form therewith an arcuate line of weakness.

4. A carton according to claim 1, wherein said lower closure flap is arcuate in shape.

5. A carton according to claim 1, wherein said lines of weakness are formed by double cut scores.

6. A carton according to claim 1, wherein said upper flap is generally pie shaped.

7. A two-piece carton with a sift-resistant, reclosable, dispensing feature, said carton comprising:

(a) an outer shell including top, bottom, side, and end walls foldably joined to each other to form a box-like structure;

(b) an inner liner including side wall and end wall panels positioned against inner surfaces of said outer shell side and end walls, respectively;

(c) one of said shell end walls consisting of a single wall panel having a dispensing opening covered by a pair of contiguous upper and lower flaps foldably joined to said one end wall panel along vertically spaced, parallel, horizontal, first and second fold lines, respectively;

(d) said lower flap being foldably joined to said one end wall along said second fold line, and being detachably joined to said one end wall;

(e) said upper flap including:

(i) an upper section foldably joined at its upper edge to said one end wall panel, along said first fold line; and (ii) a lower section joined at its upper edge to a lower edge of said upper section, along a third fold line that is aligned vertically with a horizontal upper edge of said liner;

(f) both of said upper flap sections being detachably joined to said one end wall, said upper flap lower section being detachably joined to said lower flap;

(g) said lower flap being arranged and disposed to be pushed inwardly to partially detach it from said one end wall and said upper flap and to accommodate the insertion of a finger under said upper flap;

(h) said upper flap being arranged and disposed to be lifted to partially detach it from said one end wall and to uncover said dispensing opening in said one end wall, and also being arranged and disposed to accommodate the bending of said lower section at right angles to said upper section to permit its insertion into said shell at a location immediately adjacent said inner liner horizontal upper edge to effect a relatively sift-resistant reclosure of a portion of said dispensing opening that is not already covered by said liner.

8. A carton according to claim 7, wherein said upper flap is detachably joined to said one end wall by a pair of separate, laterally spaced, generally vertically extending, downwardly converging, upper lines of weakness extending downwardly from opposite ends of said first fold lines.

9. A carton according to claim 7, wherein said lower flap is connected to said one wall and to said upper flap by an arcuate line of weakness.

10. A carton according to claim 9, wherein said lines of weakness are formed by double cut scores.

11. A carton according to claim 7, wherein said lower closure flap is arcuate in shape.

12. A carton according to claim 7, wherein said upper flap is generally pie shaped.

13. A carton according to claim 7, wherein said upper flap includes:

(a) an upper section foldably joined at its upper edge to said one end wall panel, along said first fold line; and (b) a lower section joined at its upper edge to a lower edge of said upper section, along a third fold line that is aligned vertically with a horizontal upper edge of said liner;

14. A two-piece carton with a sift-resistant, reclosable, dispensing feature, said carton comprising:

(a) an outer shell including top, bottom, side, and end walls foldably joined to each other to form a box-like structure;

(b) an inner liner including side wall and end wall panels positioned against inner surfaces of said outer shell side and end walls, respectively;

(c) one of said shell end walls consisting of a single wall panel having a dispensing opening covered by a pair of contiguous upper and lower reclosure flaps foldably joined to said one end wall panel along vertically spaced, parallel, horizontal, first and second fold lines, respectively, and being detachably joined to said one end wall and to each other by lines of weakness;

(d) said lower flap being arranged and disposed to be pushed inwardly to partially detach it from said one end wall and said upper flap and to accommodate the insertion of a finger under said upper flap;

(e) said upper flap being arranged and disposed to be lifted to partially detach it from said one end wall and to uncover said dispensing opening, and also being arranged and disposed to accommodate its insertion into said shell at a location immediately adjacent said inner liner horizontal upper edge to effect a relatively sift-resistant reclosure of a portion of the dispensing opening that is not already covered by said liner.

15. A carton according to claim 14, wherein said upper flap is detachably joined to said one end wall by a pair of separate, laterally spaced, generally vertically extending, downwardly converging, upper lines of weakness extending downwardly from opposite ends of said first fold line.

16. A carton according to claim 14, wherein said lower flap is connected to said one end wall and to said upper flap by an arcuate line of weakness.

17. A carton according to claim 16, wherein said lines of weakness are formed by double cut scores.

18. A carton according to claim 14, wherein said lower closure flap is arcuate in shape.

19. A carton according to claim 14, wherein said upper flap is generally pie shaped.

20. A carton according to claim 14, wherein said upper flap includes:

(a) an upper section foldably joined at its upper edge to said one end wall panel, along said first fold line; and (b) a lower section joined at its upper edge to a lower edge of said upper section, along a third fold line that is aligned vertically with a horizontal upper edge of said liner.

* * * * *